US006527506B2

(12) United States Patent
Pickelman et al.

(10) Patent No.: US 6,527,506 B2
(45) Date of Patent: Mar. 4, 2003

(54) PUMP SECTION FOR FUEL PUMP

(75) Inventors: Dale M. Pickelman, Saginaw, MI (US); Mohammed Aslam, Flint, MI (US); Partab Jeswani, Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/818,255

(22) Filed: Mar. 26, 2001

(65) Prior Publication Data

US 2002/0021961 A1 Feb. 21, 2002

Related U.S. Application Data

(60) Provisional application No. 60/192,590, filed on Mar. 28, 2000.

(51) Int. Cl.[7] ..... F04D 5/00
(52) U.S. Cl. ..... 415/55.1; 416/237
(58) Field of Search ..... 415/55.1–55.7; 416/237, 236 R

(56) References Cited

U.S. PATENT DOCUMENTS

| | | | | | |
|---|---|---|---|---|---|
| 2,042,499 | A | * | 6/1936 | Brady | 415/55.4 |
| 5,299,908 | A | * | 4/1994 | Robbie | 415/55.1 |
| 5,807,068 | A | * | 9/1998 | Dobler et al. | 415/55.1 |
| 6,152,687 | A | * | 11/2000 | Wilhelm et al. | 415/55.1 |

* cited by examiner

*Primary Examiner*—Edward K. Look
*Assistant Examiner*—Dwayne J. White
(74) *Attorney, Agent, or Firm*—Vincent A. Cichosz

(57) ABSTRACT

A fuel pump for a vehicle includes a pump section having a flow channel and a rotatable impeller cooperating with the flow channel to pump fuel therethrough. The fuel pump also includes a motor section disposed adjacent the pump section and having a motor to rotate the impeller. The fuel pump further includes an outlet section disposed adjacent the motor section to allow pumped fuel to exit the fuel pump. The impeller includes a plurality of blades that are generally V shaped. The pump section has an inlet port and an outlet port communicating with the flow channel and has a shape according to a face angle of the blades.

21 Claims, 4 Drawing Sheets

PUMP SECTION FOR FUEL PUMP

CROSS-REFERENCE TO RELATED APPLICATION(S)

The present invention claims the priority date of copending U.S. Provisional Patent Application Serial No. 60/192,590, filed Mar. 28, 2000.

TECHNICAL FIELD

The present invention relates generally to fuel pumps for vehicles and, more particularly, to a pump section for a fuel pump of a vehicle.

BACKGROUND OF THE INVENTION

It is known to provide a fuel tank in a vehicle to hold fuel to be used by an engine of the vehicle. It is also known to provide a fuel pump to pump fuel from the fuel tank to the engine. One type of fuel pump is known as a high-pressure turbine fuel pump. The high-pressure turbine fuel pump typically includes a pump section having an impeller rotatable between inlet and outlet plates. The impeller is of a closed vane type to improve pump efficiency and performance. The impeller has a hub portion, a plurality of blade tips extending radially from the hub portion and disposed circumferentially thereabout, power, or stumbling are shortfalls. Reduction in the loss of flow can be achieved by understanding vapor formation regions within the pump section and finding ways to address them.

Previous designs for the pump section positioned the inlet and outlet ports to match the flow channel to produce a fluid volume into both upper and lower channels of the flow channel via the impeller at the same time and position. Open vane impellers use this technique in order to start a regenerative cycle as soon as possible. Closed vane V-shaped blade impellers, however, use a tangential action of the fluid particles in order to drive the fluid at lower speeds, thereby producing a higher back pressure on the blade and causing the passage to fill both upper and lower channels to occur at differing positions and times within the in-take area for the pump section. The vapor generated by V-shaped blades in the intake area of the pump section approaches 5 psig (35 kPa) suction and, if not replaced with fuel, a vacuum can cause the vapor to be carried into the flow channel before being expelled through the outlet port.

Therefore, it is desirable to provide a pump section for a fuel pump that reduces or eliminates fuel vapors therein. It is also desirable to provide a pump section for a fuel pump to handle hot fuel therein. It is and a peripheral ring portion extending radially from the blade tips.

The ability of the pump section to produce a desired flow and pressure at environments present in fuel tanks is based on expelling the fuel vapors as efficiently as possible. The passage of V-shaped blades through the flow path channel produces a negative pressure on a backside of the blade itself. This "vacuum" displaces fuel particles that produce a fluid volume needed to achieve flow targets at given speed and pressures. At colder fuel tank temperatures, the volatility of the fuel is very stable and negative pressures seen in an inlet area of the pump section do not affect a vapor-liquid ratio. When higher temperatures occur (40 to 50 degrees Celsius), particles of air and fuel mix together with the resultant rich vapor content of the fuel and reduce the ability of the impeller to displace the volumetric fluid.

The loss of flow in the fuel pump due to elevated fuel temperatures in the fuel tank is the result of the inability of the pump section to purge vapors efficiently. The volatility of gasoline and/or reformulated gasoline at elevated temperatures is the main source for flow loss. The pump section also has lower efficiencies purging the vapors at high flow rates. For applications where the higher flow rates are demanded by an engine management system, drivability issues, loss of further desirable to provide a pump section for a fuel pump, which maximizes performance.

SUMMARY OF THE INVENTION

It is, therefore, one object of the present invention to provide a new pump section for a fuel pump in a fuel tank of a vehicle.

It is another object of the present invention to provide a pump section for a fuel pump of a vehicle that reduces or eliminates vapors generated by hot fuel.

To achieve the foregoing objects, the present invention is a fuel pump for a vehicle including a pump section having a flow channel and a rotatable impeller cooperating with the flow channel to pump fuel therethrough. The fuel pump also includes a motor section disposed adjacent the pump section and having a motor to rotate the impeller. The fuel pump further includes an outlet section disposed adjacent the motor section to allow pumped fuel to exit the fuel pump. The impeller has a plurality of blades that are generally V-shaped. The pump section has an inlet port and an outlet port communicating with the flow channel and having a shape according to a face angle of the blades.

One advantage of the present invention is that a new pump section is provided for a fuel pump in a fuel tank of a vehicle. Another advantage of the present invention is that the pump section has a channel for both the inlet plate and the outlet plate for eliminating vapors inherent or produced by passing V-shaped blades on an impeller at the in-take area of the pump section. Yet another advantage of the present invention is that the pump section handles hot fuel and maximizes performance greater than conventional pump sections for high flow/high output applications due to the geometry of rejecting the entrance of fuel vapor generated in an inlet channel of the outlet plate. Still another advantage of the present invention is that the pump section has an outlet port design for increasing flow channel arc length, thereby increasing performance for low delta pressures as the fluid exits the high-pressure pump section. A further advantage of the present invention is that the pump section has "port timing" dictated by fluid particles through the V-blade impeller at both the inlet and outlet areas. Yet a further advantage of the present invention is that the pump section eliminates fuel vapor generation by eliminating dead areas in the ports. Still a further advantage of the present invention is that the pump section allows the fuel pump to handle hot fuel at high flow rates (40 g/s at 350 kPa).

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
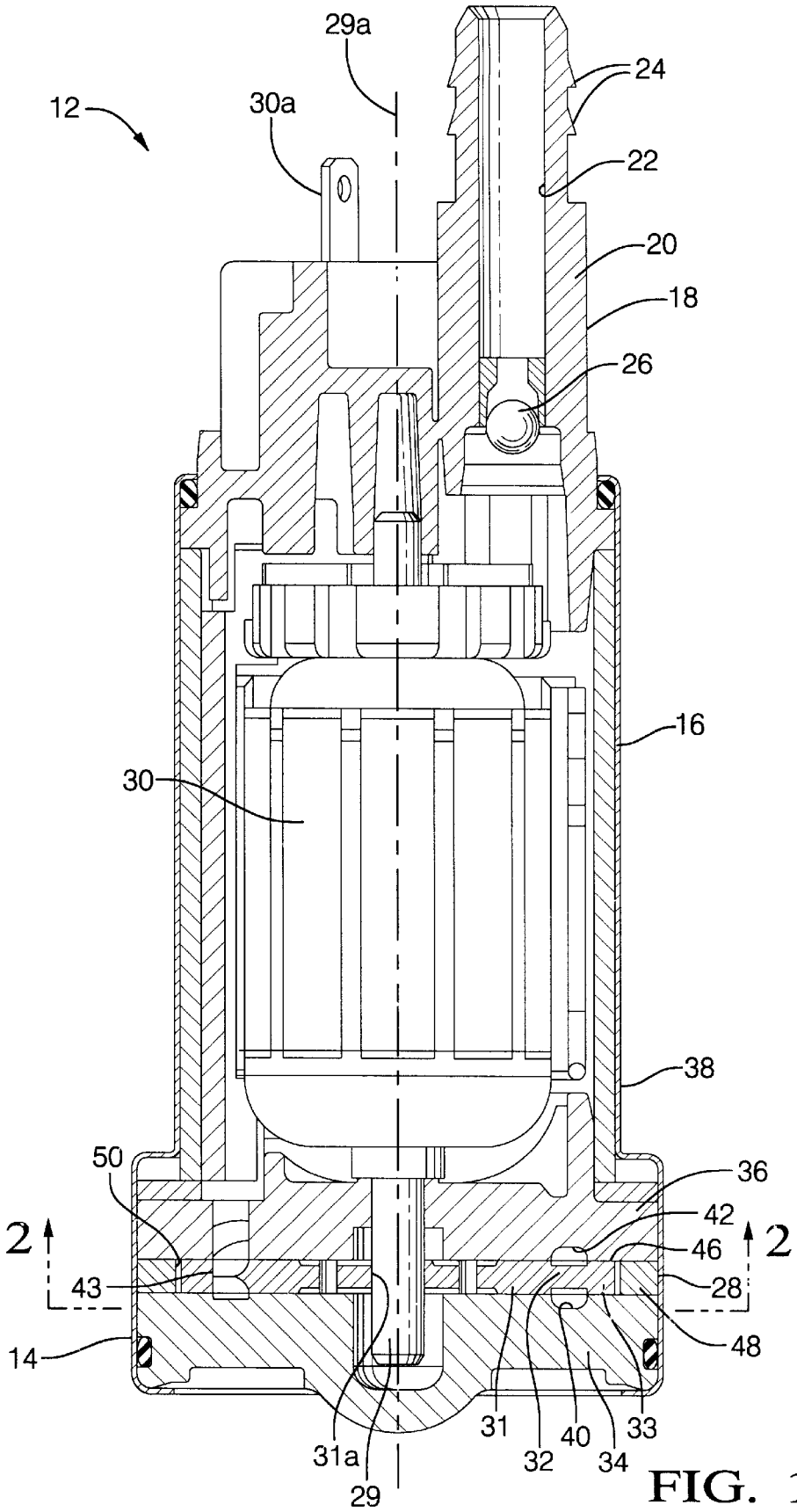
FIG. 1 is a fragmentary elevational view of a fuel pump, according to the present invention.
Figure 2:
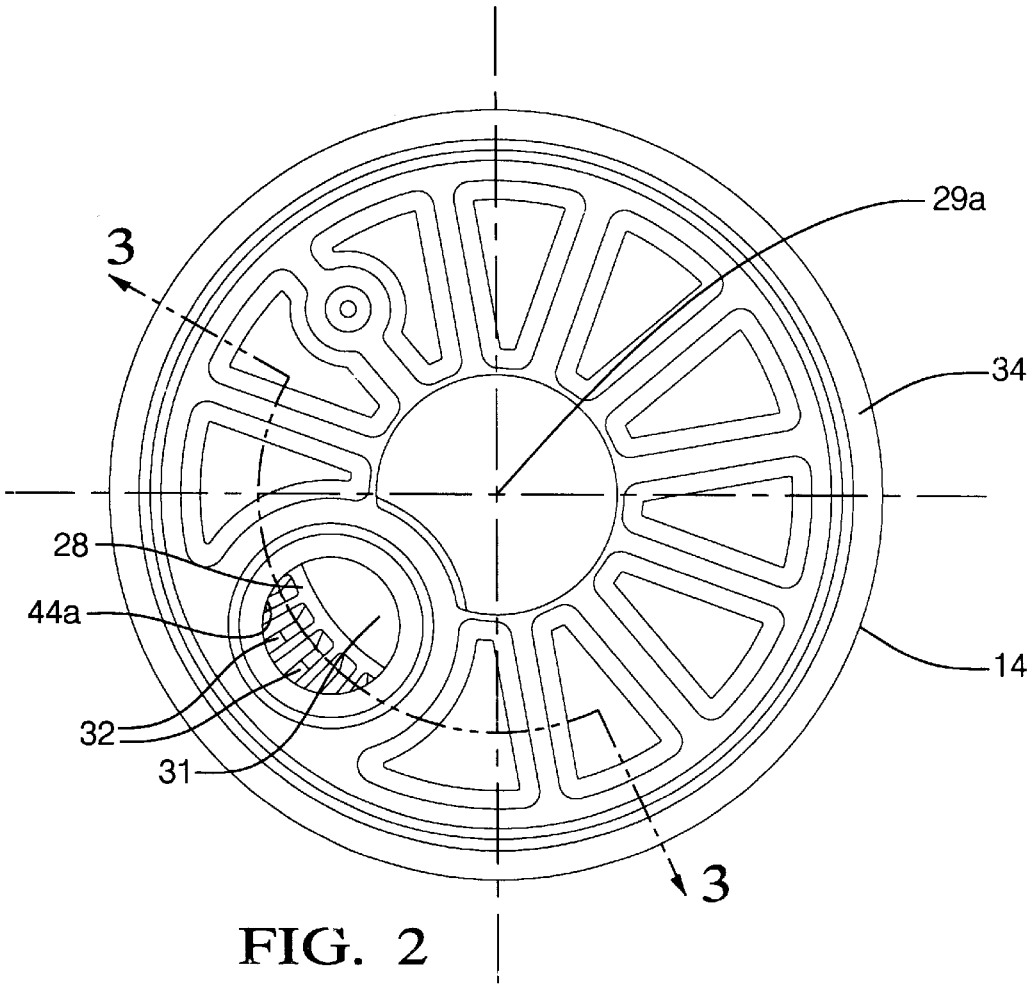
FIG. 2 is a plan view of a pump section, according to the present invention, of the fuel pump taken along line 2—2 of FIG. 1.

Referring to the drawings and in particular FIGS. 1 and 2, one embodiment of a regenerative turbine fuel pump 12, according to the present invention, is shown for a vehicle (not shown). The fuel pump 12 includes a pump section 14 at one axial end, a motor section 16 adjacent the pump section 14, and an outlet section 18 adjacent the motor section 16 at the other axial end. As known in the art, fuel enters the pump section 14, which is rotated by the motor section 16, and is pumped past the motor section 16 to the outlet section 18. The outlet section 18 has an outlet member 20 extending axially with a passageway 22 extending axially therethrough. The outlet member 20 also has a plurality of projections or barbs 24 extending radially outwardly for attachment to a conduit (not shown). The outlet member 20 also includes a check valve 26 disposed in the passageway 22. It should be appreciated that the fuel flowing to the outlet section 18 flows into the outlet member 20 and through the passageway 22 and check valve 26 when open to the conduit. It should also be appreciated that, except for the pump section 14, the fuel pump 12 is conventional and known in the art.

Figure 3:
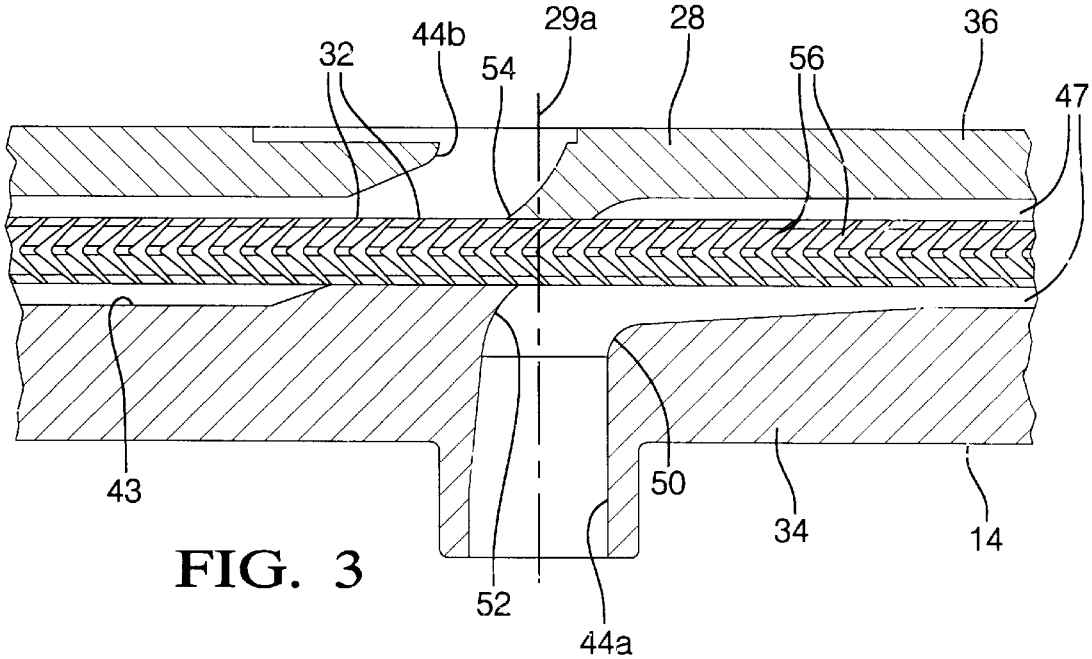
FIG. 3 is a sectional view taken along line 3—3 of FIG. 2.

Referring to FIGS. 1 through 3, the pump section 14, according to the present invention, includes an impeller 28 that serves as the rotary pumping element from the regenerative turbine fuel pump 12. The impeller 28 takes the form of a disk mounted to a rotatable armature shaft 29 of an electric motor 30 of the motor section 16 for rotation therewith. The impeller 28 is generally planar and circular in shape. The impeller 28 has a hub portion 31 that defines an aperture 31*a* at its center and is attached to the shaft 29. The aperture 31*a* is notched to accommodate the like-shaped shaft 29 of the motor 30. It should be appreciated that the notched aperture 31*a* allows the shaft 29 to drive the impeller 28 when the electric motor 30 is activated.

The impeller 28 also has a plurality of blade tips 32 extending radially outward from the hub portion 31 and disposed circumferentially thereabout. The impeller 28 has a peripheral ring portion 33 extending radially from the blade tips 32 to shroud the blade tips 32. The impeller 28 is made of a rigid material such as plastic. It should be appreciated that the shaft 29 rotates about a longitudinal center axis 29*a*. It should also be appreciated that a terminal 30*a* projects from one end of a housing 38 and is connected to a wiring harness (not shown) of the vehicle to supply electrical energy to the motor 30.

The pump section 14 also includes an inlet plate 34 disposed axially on one side of the impeller 28 and an outlet plate 36 disposed axially on the other side of the impeller 28. The inlet plate 34 and outlet plate 36 are generally planar and circular in shape. The inlet plate 34 and outlet plate 36 are enclosed by a tubular metal shell or metal pump housing 38 and fixed thereto. The inlet plate 34 and outlet plate 36 have an annular inlet or first groove or recess 40 and an annular outlet or second groove or recess 42, respectively, located axially opposite the blade tips 32 adjacent to the peripheral ring portion 33 to form an annular flow or pump channel 43 for a function to be described.

The fuel tank of the vehicle fluidly communicates with the annular pump channel 43 through an inlet port 44*a* in the inlet plate 34. This communication occurs through the annular groove 40 on the inlet side of the impeller 28, as well as through known passageways internal to the fuel pump 12. The outlet member 20 of the outlet section 18 is fluidly connected to an outlet port 44*b* in the outlet plate 36 via other known passageways within the fuel pump 12 through the outlet port 44*b*, the outlet member 20 fluidly communicates with the annular pump channel 43 on the outlet side of the impeller 28. It should be appreciated that, from the outlet member 20, pressurized fuel is discharged from and delivered by the fuel pump 12 for use by the engine of the vehicle.

The recesses 40 and 42 are generally annular and allow fuel to flow therethrough from the inlet port 44*a* to the outlet port 44*b* of the pump section 14. The peripheral ring portion 33 of the impeller 28 forms an outside diameter (OD) sealing surface 46 on both axial sides thereof with the inlet plate 34 and outlet plate 36. It should be appreciated that the impeller 28 rotates in a generally disk-shaped space 47 between and relative to the inlet plate 34 and outlet plate 36. It should also be appreciated that the inlet plate 34 and outlet plate 36 are stationary relative to the impeller 28.

The pump section 14 also includes a spacer ring 48 disposed axially between the inlet plate 34 and outlet plate 36 and spaced radially from the impeller 28 to form a gap 50 therebetween. The spacer ring 48 is fixed to the housing 38 and is stationary relative to the impeller 28. The spacer ring 48 is generally planar and circular in shape.

Referring to FIGS. 1 through 3, the blade tips 32 have an inner diameter and an outer diameter and extend radially between the inner diameter and the outer diameter. The blade tips 32 of the impeller 28 each have a fan vane or blade 56 that is generally spaced from each other uniformly. Each blade 56 is generally "V" shaped. The blades 56 may have a blade thickness at the inner diameter 52 greater than a blade thickness at the outer diameter 54. The blades 56 have a predetermined blade angle such as forty-five degrees from a root blade thickness to an edge blade thickness. The blades 56 have a back chamfer angle of a predetermined amount, preferably sixty degrees, to create low pressure at passage. The blades 56 are located in between and adjacent to the annular grooves 40 and 42 in the inner and outer plates 34 and 36, respectively, and located directly within the channel of the regenerative turbine fuel pump 12. The blade tips 32 also have a plurality of blade cavities 62 disposed between the blades 56. It should be appreciated that fluid flows into the inlet recess 40, through the blade cavities 62, and out the outlet recess 42.

As illustrated in FIG. 3, the inlet port 44*a* has an inner inlet radius 50 and an outer inlet radius 52. The radii 50 and 52 are arcuate in shape and have a predetermined value such as 2.0 millimeters and 9.3 millimeters, respectively. The outlet port 44*b* is advanced according to the face angle of the blades 56 relative to the groove 40 of the inlet plate 34 and is located closer to the longitudinal axis 29*a*. The outlet port 44*b* has a ramp 54 that is longer with a shallower convergent angle. As a result, the flow channel 43 has a longer arc length to allow the pump section 14 to deliver a higher static head pressure and to exit the fuel with the lowest pressure co-efficient, K, thereby decreasing torque generated to drive the fluid and improving the efficiency of the pump section 14. It should be appreciated that the directional fluid path results in passing the fluid from the inlet port 44*a* to the outlet port 44*b* in a more efficient manner.

Figure 4:
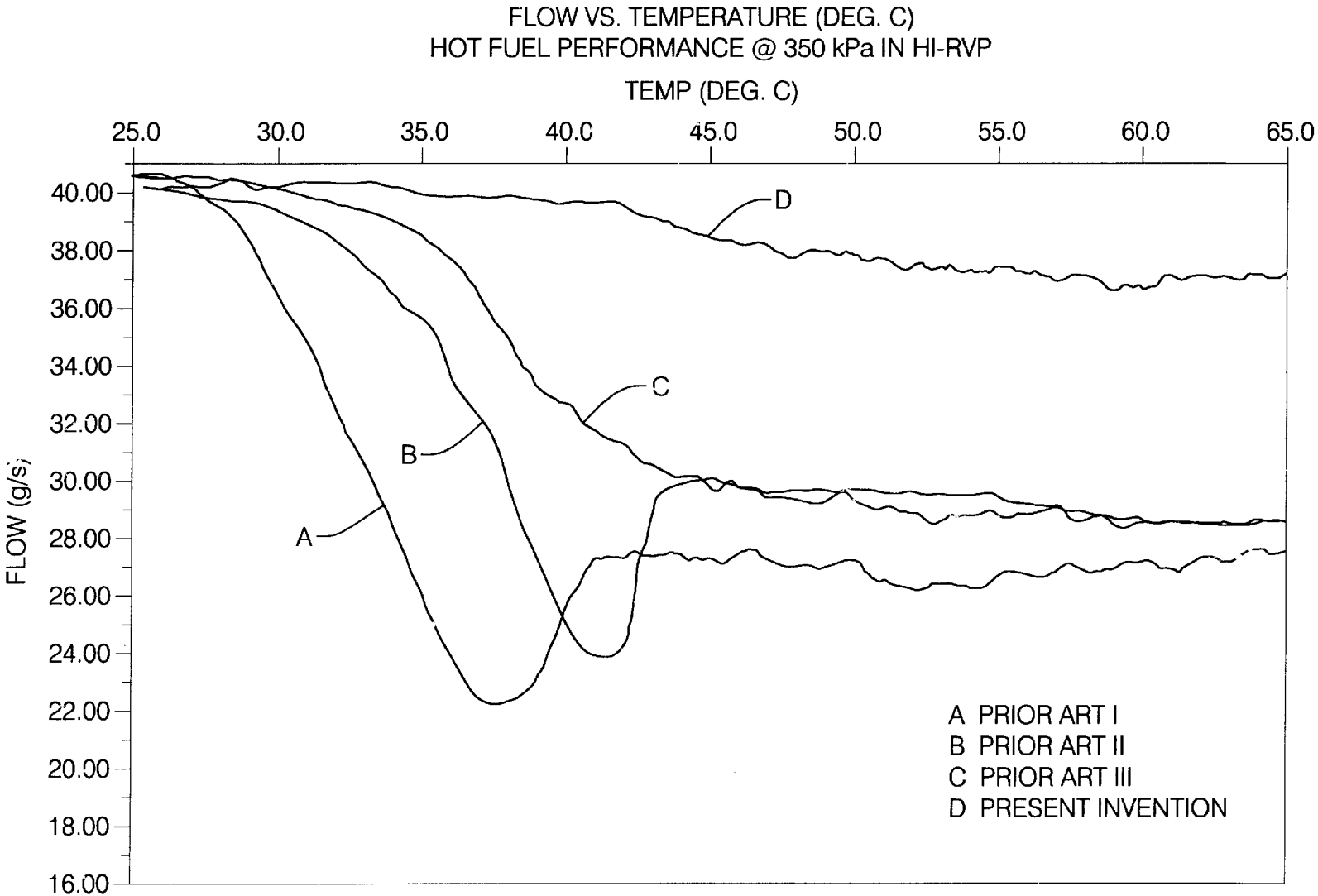
FIG. 4 is a graphical view of flow versus temperature for hot fuel performance of prior art designs and the pump section of FIG. 2.
Figure 5:
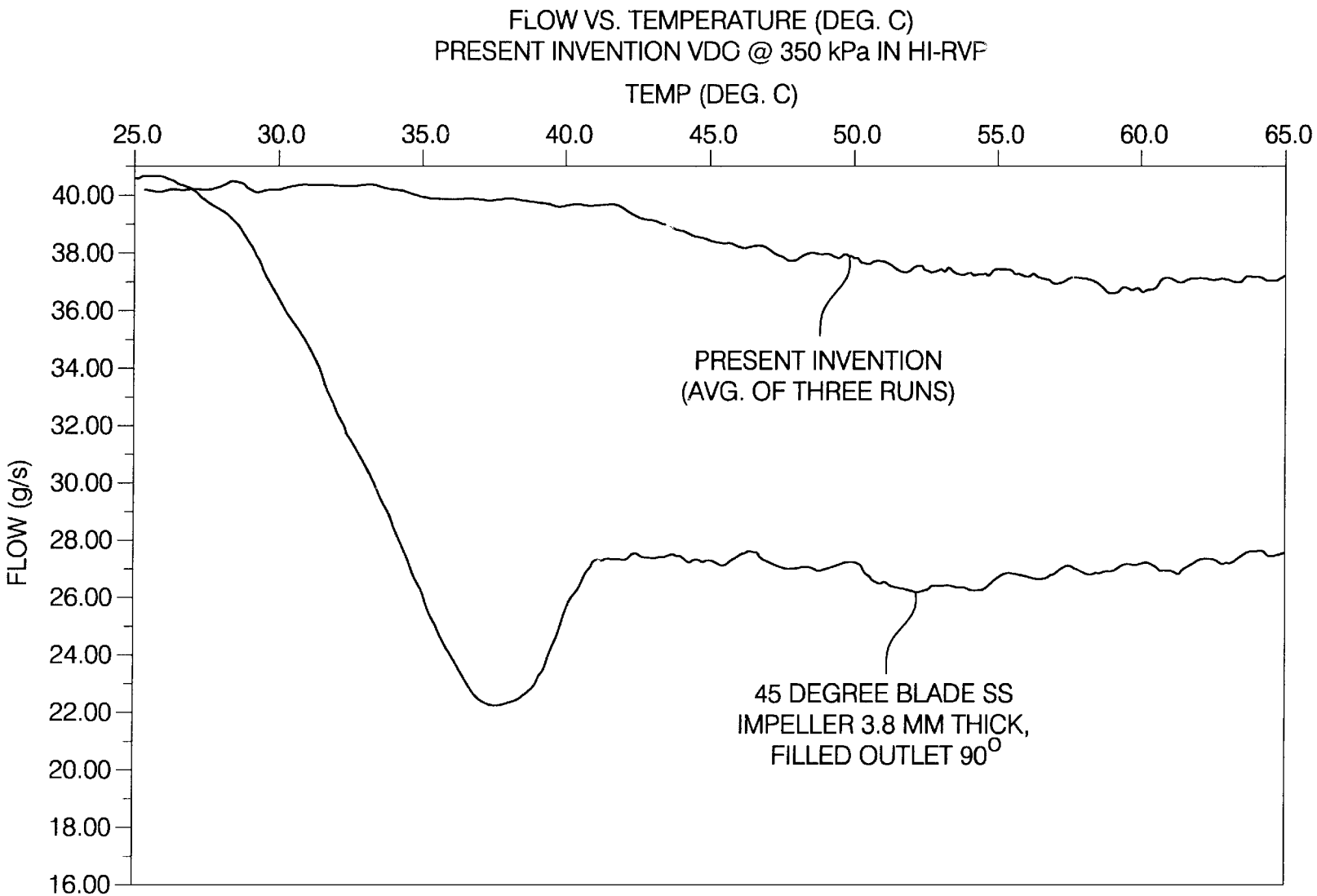
FIG. 5 is a graphical view of flow versus temperature for hot fuel performance of the pump section of FIG. 2.

Referring to FIG. 4, results showing the ability of the pump section 14 to purge vapors from the flow channel 43 and improved performance in the vapor rich condition of the pump section 14 are compared to conventional designs. As illustrated, flow versus temperature is graphed for hot fuel performance of the pump section 14 of the present invention and prior art. The pump section 14 of the present invention had a higher flow rate of fuel at increased temperatures than the prior art. In the pump section 14 of the present invention, the face blade angle and back chamfer with a wider width impeller 28 produced an increase in performance. In addition, increasing the ramp angle distance for the inlet port 44*a* and the outlet port 44*b* and converging regenerative flow before expelling the fuel vapors increased performance. As illustrated in FIG. 5, results showing improved performance of the pump section 14 of the present invention is shown versus a conventional design. As illustrated, flow versus temperature is graphed for hot fuel performance of the pump section 14 of the present invention and the prior art. The pump section 14 of the present invention had a higher flow rate of fuel at increased temperatures than the prior art.

In operation of the regenerative turbine fuel pump 12, when electricity is supplied via the terminal to the electric motor 30, the armature shaft 29 begins to rotate. The rotation of the shaft 29, in turn, causes the impeller 28 to rotate within the disk-shaped space between the inner and outer plates 34 and 36. Fuel from the fuel tank is sucked into the inlet port 44*a* and flows into the annular groove 40, and thus into the annular pump channel 43. As the impeller 28 rotates, its V-shaped blades 56, in combination with annular grooves 40 and 42 on either side, cause the fuel to whirl about the annular pump channel 43 in a toroidal path. In particular, as the impeller 28 rotates, the fuel exits each blade 56 at the tip and then re-enters the base of the trailing blade 56. As is known in the art, this regenerative cycle of exiting the tip of the leading blade 56 and entering the base of the trailing blade 56 occurs many times as the fuel is conveyed through the annular pump channel 43 by the blades 56 moving on the periphery of the impeller 28.

As the impeller 28 rotates, the movement of the V-shaped blades 56 through the annular pump channel 43 imparts momentum to the fuel as it flows along the torodial flow path. On the outlet side of the impeller 28 (i.e., through the annular groove 42), the fast moving fuel then flows through the outlet port 44*b* defined in the outlet plate 36. The fuel flows from the inlet port 44*a* through the flow channel 43 to the outlet port 44*b*. From the outlet port 44*b*, the fuel continues flowing through the internal passageways of the fuel pump 12 and exits the fuel pump 12 through the outlet member 20. In this known manner, fuel at relatively high pressure is provided to the engine of the vehicle at an appropriate rate of flow.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A fuel pump for a vehicle comprising:

a pump section having a flow channel and a rotatable impeller cooperating with said flow channel to pump fuel therethrough;

a motor section disposed adjacent said pump section and having a motor to rotate said impeller;

an outlet section disposed adjacent said motor section to allow pumped fuel to exit said fuel pump;

said impeller including a plurality of blades that are generally V shaped; and said pump section having an inlet port and an outlet port communicating with said flow channel, said outlet port being advanced according to a face angle of said blades relative to said inlet port.

2. A fuel pump as set forth in claim 1 wherein the face angle of said blades is forty-five degrees.

3. A fuel pump as set forth in claim 1 wherein said pump section includes an inlet plate disposed axially adjacent one side of said impeller.

4. A fuel pump as set forth in claim 3 wherein said pump section includes an outlet plate disposed axially adjacent an opposed side of said impeller.

5. A fuel pump as set forth in claim 4 wherein said inlet plate has an inside face that defines a first annular groove communicating with said inlet port.

6. A fuel pump as set forth in claim 5 wherein said outlet plate has an inside face that defines a second annular groove communicating with said outlet port.

7. A fuel pump for a vehicle comprising:

a pump section having a flow channel and a rotatable impeller cooperating with said flow channel to pump fuel therethrough;

a motor section disposed adjacent said pump section and having a motor to rotate said impeller;

an outlet section disposed adjacent said motor section to allow pumped fuel to exit said fuel pump;

said impeller including a plurality of blades that are generally V shaped;

said pump section having an inlet port and an outlet port communicating with said flow channel; and wherein said inlet port has an inner inlet radius and an outer inlet radius, said inner inlet radius having a radii less than said outer inlet radius.

8. A fuel pump for a vehicle comprising:

a pump section having a flow channel and a rotatable impeller cooperating with said flow channel to pump fuel therethrough;

a motor section disposed adjacent said pump section and having a motor to rotate said impeller;

an outlet section disposed adjacent said motor section to allow pumped fuel to exit said fuel pump;

said impeller including a plurality of blades that are generally V shaped;

said pump section having an inlet port and an outlet port communicating with said flow channel; and wherein said outlet port overlaps a longitudinal axis of said pump section.

9. A fuel pump for a vehicle comprising:

a pump section having a flow channel and a rotatable impeller cooperating with said flow channel to pump fuel therethrough;

a motor section disposed adjacent said pump section and having a motor to rotate said impeller;

an outlet section disposed adjacent said motor section to allow pumped fuel to exit said fuel pump;

said impeller including a plurality of blades that are generally V shaped;

said pump section having an inlet port and an outlet port communicating with said flow channel; and wherein said outlet port has a ramp of a shallow convergence.

10. A fuel pump for a vehicle comprising:

a pump section having a flow channel and a rotatable impeller cooperating with said flow channel to pump fuel therethrough;

a motor section disposed adjacent said pump section and having a motor to rotate said impeller;

an outlet section disposed adjacent said motor section to allow pumped fuel to exit said fuel pump;

said impeller including a plurality of blades that are generally V shaped;

said pump section having an inlet port and an outlet port communicating with said flow channel; and wherein said blades are angled from an inner diameter to an outer diameter.

11. A fuel pump for a vehicle comprising:

a pump section having a flow channel and a rotatable impeller cooperating with said flow channel to pump fuel therethrough;

a motor section disposed adjacent said pump section and having a motor to rotate said impeller;

an outlet section disposed adjacent said motor section to allow pumped fuel to exit said fuel pump;

said impeller including a plurality of blades that are generally V shaped;

said pump section having an inlet port and an outlet port communicating with said flow channel; and wherein said blades have a back chamfer of sixty degrees.

12. A fuel pump for a fuel tank in a vehicle comprising:

a housing;

a pump section disposed in said housing having an inlet plate and an outlet plate spaced longitudinally from said inlet plate to define a flow channel therebetween and a rotatable impeller cooperating with said flow channel to pump fuel therethrough;

a motor section disposed in said housing adjacent said pump section and having a motor to rotate said impeller;

an outlet section disposed in said housing adjacent said motor section to allow pumped fuel to exit said fuel pump;

said impeller including a plurality of blades that are generally V shaped; and said pump section having an inlet port in said inlet plate and an outlet port in said outlet plate communicating with said flow channel, said outlet port being advanced according to a face angle of said blades relative to said inlet port.

13. A fuel pump as set forth in claim 12 wherein the face angle of said blades is forty-five degrees.

14. A fuel pump as set forth in claim 12 wherein said inlet plate has an inside face that defines a first annular groove communicating with said inlet port.

15. A fuel pump as set forth in claim 14 wherein said outlet plate has an inside face that defines a second annular groove communicating with said outlet port.

16. A fuel pump for a fuel tank in a vehicle comprising:

a housing;

a pump section disposed in said housing having an inlet plate and an outlet plate spaced longitudinally from said inlet plate to define a flow channel therebetween and a rotatable impeller cooperating with said flow channel to pump fuel therethrough;

a motor section disposed in said housing adjacent said pump section and having a motor to rotate said impeller;

an outlet section disposed in said housing adjacent said motor section to allow pumped fuel to exit said fuel pump;

said impeller including a plurality of blades that are generally V shaped;

said pump section having an inlet port in said inlet plate and an outlet port in said outlet plate communicating with said flow channel; and wherein said inlet port has an inner inlet radius and an outer inlet radius, said inner inlet radius having a radii less than said outer inlet radius.

17. A fuel pump for a fuel tank in a vehicle comprising:

a housing;

a pump section disposed in said housing having an inlet plate and an outlet plate spaced longitudinally from said inlet plate to define a flow channel therebetween and a rotatable impeller cooperating with said flow channel to pump fuel therethrough;

a motor section disposed in said housing adjacent said pump section and having a motor to rotate said impeller;

an outlet section disposed in said housing adjacent said motor section to allow pumped fuel to exit said fuel pump;

said impeller including a plurality of blades that are generally V shaped;

said pump section having an inlet port in said inlet plate and an outlet port in said outlet plate communicating with said flow channel; and wherein said outlet port overlaps a longitudinal axis of said pump section.

18. A fuel pump for a fuel tank in a vehicle comprising:

a housing;

a pump section disposed in said housing having an inlet plate and an outlet plate spaced longitudinally from said inlet plate to define a flow channel therebetween and a rotatable impeller cooperating with said flow channel to pump fuel therethrough;

a motor section disposed in said housing adjacent said pump section and having a motor to rotate said impeller;

an outlet section disposed in said housing adjacent said motor section to allow pumped fuel to exit said fuel pump;

said impeller including a plurality of blades that are generally V shaped;

said pump section having an inlet port in said inlet plate and an outlet port in said outlet plate communicating with said flow channel; and wherein said outlet port has a ramp of a shallow convergence.

19. A fuel pump for a fuel tank in a vehicle comprising:

a housing;

a pump section disposed in said housing having an inlet plate and an outlet plate spaced longitudinally from said inlet plate to define a flow channel therebetween and a rotatable impeller cooperating with said flow channel to pump fuel therethrough;

a motor section disposed in said housing adjacent said pump section and having a motor to rotate said impeller;

an outlet section disposed in said housing adjacent said motor section to allow pumped fuel to exit said fuel pump;

said impeller including a plurality of blades that are generally V shaped;

said pump section having an inlet port in said inlet plate and an outlet port in said outlet plate communicating with said flow channel; and wherein said blades are angled from an inner diameter to an outer diameter.

20. A fuel pump for a fuel tank in a vehicle comprising:

a housing;

a pump section disposed in said housing having an inlet plate and an outlet plate spaced longitudinally from said inlet plate to define a flow channel therebetween and a rotatable impeller cooperating with said flow channel to pump fuel therethrough;

a motor section disposed in said housing adjacent said pump section and having a motor to rotate said impeller;

an outlet section disposed in said housing adjacent said motor section to allow pumped fuel to exit said fuel pump;

said impeller including a plurality of blades that are generally V shaped;

said pump section having an inlet port in said inlet plate and an outlet port in said outlet plate communicating with said flow channel; and wherein said blades have a back chamfer of sixty degrees.

21. A fuel pump for a vehicle comprising:

a housing;

a pump section disposed in said housing having an inlet plate and an outlet plate spaced longitudinally from said inlet plate to define a flow channel therebetween and a rotatable impeller cooperating with said flow channel to pump fuel therethrough, said impeller having a hub portion, a plurality of blade tips extending radially from and disposed circumferentially about said hub portion and a peripheral ring portion extending radially from said blade tips;

a motor section disposed in said housing adjacent said pump section and having a motor to rotate said impeller;

an outlet section disposed in said housing adjacent said motor section to allow pumped fuel to exit said fuel pump;

said impeller including a plurality of blades that are generally V shaped; and said pump section having an inlet port in said inlet plate and an outlet port in said outlet plate communicating with said flow channel, said outlet port being advanced according to a face angle of said blades relative to said inlet port.

* * * * *